US009767629B1

(12) United States Patent
Gulati

(10) Patent No.: US 9,767,629 B1
(45) Date of Patent: Sep. 19, 2017

(54) SYSTEM AND METHOD FOR CONTROLLING ACCESS TO VEHICLE

(71) Applicant: NXP B.V., Eindhoven (NL)

(72) Inventor: Sumeet Gulati, Bangalore (IN)

(73) Assignee: NXP B.V., San Jose, CA (US)

( * ) Notice: Subject to any disclaimer, the term of this patent is extended or adjusted under 35 U.S.C. 154(b) by 0 days.

(21) Appl. No.: 15/452,419

(22) Filed: Mar. 7, 2017

(51) Int. Cl.
*G07C 9/00* (2006.01)

(52) U.S. Cl.
CPC ..... *G07C 9/00007* (2013.01); *G07C 9/00309* (2013.01); *G07C 2009/0042* (2013.01)

(58) Field of Classification Search
CPC ..... G07C 9/00309; G07C 2009/00769; G07C 9/00111; G07C 9/00007; G07C 9/00571; G07C 2009/00793; G07C 2209/63
USPC ..... 340/5.61
See application file for complete search history.

(56) References Cited

U.S. PATENT DOCUMENTS 5,959,540 A 9/1999 Walter
6,041,410 A * 3/2000 Hsu ..... G06K 9/00013 380/285
6,275,141 B1 8/2001 Walter
6,386,007 B1 5/2002 Johnson et al.
7,075,409 B2 7/2006 Guba
8,036,647 B2 * 10/2011 Matsumura ..... G06Q 10/00 340/933
9,043,080 B2 5/2015 Bock et al.
9,499,129 B1 * 11/2016 Penilla ..... B60R 25/2018
9,582,949 B2 * 2/2017 Brown ..... G07C 9/00896
9,586,596 B2 * 3/2017 Todasco ..... B60W 50/12
9,691,198 B2 * 6/2017 Cheng ..... G07C 9/00007
2002/0173885 A1 * 11/2002 Lowrey ..... G07C 5/008 701/31.4
2007/0100514 A1 5/2007 Park
2013/0099892 A1 4/2013 Tucker et al.

FOREIGN PATENT DOCUMENTS

EP 1101670 A2 3/2002

* cited by examiner

*Primary Examiner* — Mark Blouin
(74) *Attorney, Agent, or Firm* — Charles E. Bergere

(57) ABSTRACT

A system for controlling access to a vehicle includes a first portable device and an access controller. The access controller stores an unshared password and an access control parameter (ACP). The first portable device stores the unshared password and generates an access mode signal and a shared password. In a first access mode, the access controller provides full access to the vehicle based on a first lock signal and the unshared password. In a second access mode, the access controller provides limited access to the vehicle based on a second lock signal and the shared password. In a third access mode, the access controller provides limited access to the vehicle for a predetermined time based on a third lock signal. The access controller generates a control output signal and an ignition control signal based on the ACP and the shared password to allow only limited access to the vehicle.

20 Claims, 6 Drawing Sheets

SYSTEM AND METHOD FOR CONTROLLING ACCESS TO VEHICLE

BACKGROUND

The present invention relates generally to vehicles such as cars, and more particularly, to a system and method for controlling access to a vehicle.

Generally, a system for controlling access to a vehicle includes an access controller and a portable device (e.g., a key fob). The access controller is located inside the vehicle and the portable device is carried by a user. The portable device may be a key fob that is used to unlock the vehicle and enable the vehicle ignition system. The portable device has a stored password. To access the vehicle, the user activates the portable device such as by pushing a button to transmit the password to the access controller. The access controller compares the received password with its own stored password. If the passwords match, then the access controller unlocks the vehicle, allowing a person to access the vehicle.

Oftentimes, public places such as hospitals, hotels and restaurants have dedicated vehicle parking areas, which may be a significant distance from the hotel or hospital, etc. Hence, for convenience, a valet may be employed to park the vehicles. However, for a valet to park the vehicle, the driver must share the portable device with the valet, which not only gives the valet access to the vehicle, but also to systems or devices within the vehicle, such as an in-car communication and entertainment system, air-conditioning system, fuel tank, and storage compartments. It may be desirable that the valet only has limited or partial access to the features of the vehicle. Further, allowing others to have the portable device, even temporarily, leaves the device open to being cloned, and the password copied. Thus, after the portable device is returned to the owner, the clone device could be used to unlock and operate the vehicle.

A known technique to prevent the misuse of the vehicle and systems/devices therein is to have a portable device that has different operating modes. In a first access mode, access is restricted to the owner (or a designated person) only, and in a second access mode, access is shared with another person, e.g., a valet. When the device is in the first access mode, an unshared password is generated, and in the second access mode, a shared password is generated by the device. In the first access mode, the unshared password allows full access to the vehicle, and in the second access mode, the shared password allows limited access to the vehicle, such as to only the driver's door lock and the ignition, but not to the storage compartments, gas tank, or vehicle entertainment systems. The second (valet) mode could also limit vehicle speed and the distance the vehicle can travel. Such limited access ensures safety and prevents misuse of the vehicle and its devices. However, the portable device is still physically shared with another person, e.g., the valet, such that it still is susceptible to being lost or cloned and at least the shared password copied. And since the portable device enables the ignition system regardless of the access mode, a cloned device and shared password can be used to operate the vehicle after returning the portable device to the owner.

A known technique to overcome the problem of sharing the portable device with others is to have more than one portable device, where the portable device includes a second device that allows limited access and that is separable from the first device that provides full access. Then, the owner can share the second device yet maintain control of the first device. However, the second device is still susceptible to being lost or cloned.

Another known vehicle access system avoids the problem of sharing the portable device by having a first portable device that is carried by the owner/driver and a second portable device that is carried by the valet, where the second portable device is a wireless transceiver such as a mobile phone. The first portable device transmits (wirelessly) the shared password to the second portable device, in the second access mode. The valet then uses the second portable device to transmit the shared password to the vehicle access controller to access the vehicle. With such a system, the valet does not have to manage multiple portable devices, so it is easier for the valet to keep track of the means of accessing multiple vehicles. In addition, since the owner maintains control of the first portable device, it is not susceptible to being lost or cloned by another. However, the valet still has access to the vehicle for an indefinite time interval during which the shared password may be copied.

It would be advantageous to have a system and method that controls access to a vehicle for a predetermined time period without sharing a portable device of the owner.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION

Figure 1:
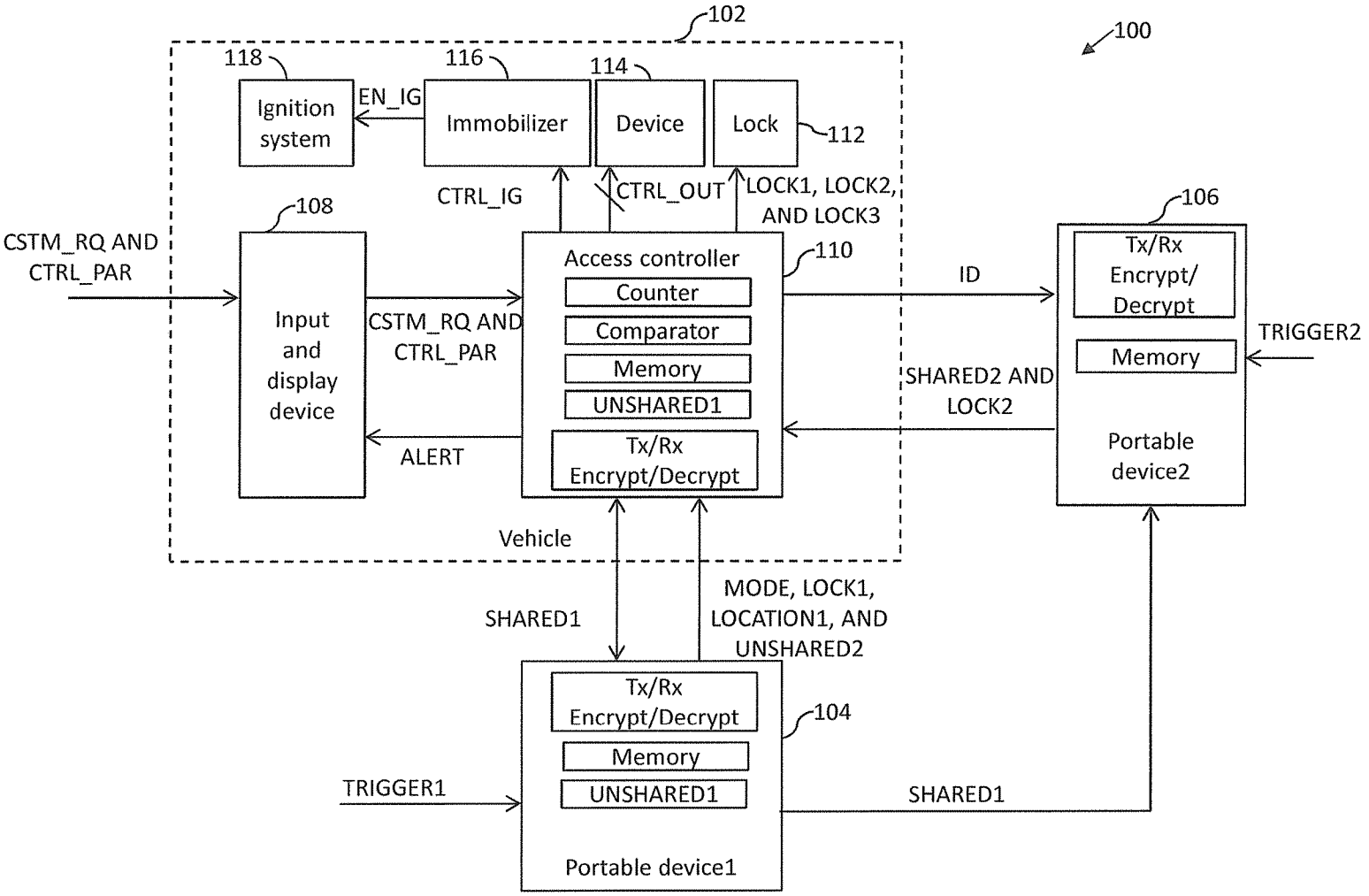
FIG. 1 is a schematic block diagram of a system for controlling access to a vehicle in accordance with an embodiment of the present invention.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In one embodiment, the present invention provides a system for controlling access to a vehicle. The system includes a first portable device and an access controller. The access controller is located within the vehicle and has a memory that stores a first unshared password, a first shared password, and at least one access control parameter (ACP). The first portable device, which is in communication with the access controller, generates and transmits an access mode signal, a first lock signal, and a second unshared password to the access controller. The access mode signal indicates at least one of a first access mode and a second access mode (e.g., normal or full access mode and valet mode, respectively). The access controller compares the first and second unshared passwords and provides access to the vehicle based on the first lock signal and the comparison result. When the access mode signal indicates the second access mode, the access controller receives a second lock signal and a second shared password from the second portable device and compares the first and second shared passwords. The access controller also generates a control output signal and an ignition control signal based on the ACP and the comparison of the first and second shared passwords. The access controller also controls access to the vehicle based on the second lock signal, the control output signal, and the ignition control signal.

In another embodiment, the present invention provides a method for controlling access to a vehicle. The method comprises storing a first unshared password, a first shared password, and at least one access control parameter (ACP) by an access controller, which is located within the vehicle. The method further comprises generating an access mode signal that indicates at least one of a first access mode and a second access mode, a first lock signal, and a second unshared password by a first portable device. The method further comprises transmitting the access mode signal, the first lock signal, and the second unshared password from the first portable device to the access controller. The access controller then compares the second unshared password with the first unshared password, and provides the access to the vehicle based on the first lock signal and the comparison result. The method further comprises receiving a second shared password and a second lock signal by the access controller when the access mode signal indicates the second access mode. The access controller then compares the second shared password with the first shared password and generates a control output signal and an ignition control signal based on the corresponding at least one ACP and the comparison between the first and second shared passwords when the access mode signal indicates the second access mode. The method further includes controlling the access to the vehicle based on the second lock signal, the control output signal, and the ignition control signal.

Various embodiments of the present invention provide a system and method for controlling access to a vehicle. The system includes a first portable device (e.g., a key fob) and an access controller that is located within the vehicle. The access controller, a door lock, and at least one device/system are located inside the vehicle. The access controller stores a first unshared password, a first shared password, and at least one access control parameter (ACP). The first portable device generates an access mode signal, a second unshared password, and a first lock signal based on at least one first trigger signal. When the mode signal indicates the first access mode, then the access controller compares the first and second unshared passwords and verifies the first portable device when the first and second unshared passwords match. When the unshared passwords match, the access controller activates (or deactivates) the vehicle door lock based on the first lock signal, and provides access to the vehicle and the vehicle systems (e.g., in-vehicle entertainment, storage compartments, etc.).

When the user wants to share access to the vehicle, such as with a valet, the user changes the access mode to either the second access mode or a third access mode using the access mode signal to indicate either the second or third access mode. When the access mode signal indicates the second access mode, the access controller generates and transmits the first shared password to a second portable device, which can be carried by the valet, by way of the first portable device. The second portable device generates and transmits a second lock signal and a second shared password to the access controller based on a second trigger signal. The access controller compares the second shared password with the first shared password and verifies the second portable device when the first and second shared passwords match. When the shared passwords match, the access controller generates a control output signal and an ignition control signal based on the at least one ACP. The access controller activates or deactivates the door lock, controls access to the devices/systems, and enables or disables the vehicle ignition system based on the second lock signal, the control output signal, and the ignition control signal, respectively.

The access controller can be used to control access to the vehicle and to the vehicle devices/systems when, for example, the vehicle owner (or delegate thereof) shares the vehicle with a third-party (i.e., a valet). In a presently preferred embodiment, the access controller provides access to the vehicle and its devices/systems for only a predetermined time period and the first portable device (and the first unshared password) does not need to be shared with the third-party, which prevents copying and cloning of these passwords and or the first portable device, respectively, thereby ensuring the security of the vehicle and its devices/systems.

Vehicle service stations and public places such as restaurants, hotels, malls, shopping complexes, and hospitals have valet parking facilities in which a vehicle user shares access to the vehicle with another person. Usually, the other person is a vehicle-service attendant or a valet. The vehicle-service attendant or the valet accesses the vehicle, drives it to a parking area, and parks it in the parking area. This is referred to as a 'drop-off' of the vehicle. When the owner requires the vehicle, the vehicle-service attendant or valet accesses the vehicle and drives it from the parking area to a designated pick-up location. This is referred to as a 'pick-up' of the vehicle. Note, as used herein, vehicle owner may include the actual owner of the vehicle as well as anyone authorized by the owner to use the vehicle, and in a broader sense means anyone the vehicle owner or her authorized delegate allows to have the first portable device.

Referring now to FIG. 1, a schematic block diagram of a system 100 for controlling access to a vehicle 102 in accordance with an embodiment of the present invention is shown. Controlled access to the vehicle 102 ensures security and safety thereof when it is with a valet or third-party. While the invention is described herein with respect to a vehicle, it will be understood that the inventive concepts herein can be applied to securing access to other objects, such as homes, buildings, vaults, or the like. In addition, the term "owner" is used herein to refer not only to the vehicle owner, but also to one who is in control of the vehicle such as a co-owner, a relative, or other person, in contrast to a temporary user such as a valet or service station employee.

In the presently preferred embodiment, the system 100 includes first and second portable devices 104 and 106 that are portable or moveable, and thus separable from the vehicle 102. According to the present invention, it is foreseen that the first portable device 104 is akin to a master key and remains in the control of the vehicle owner, while the second portable device is a temporary key that may be used to access the vehicle by third-parties. The first portable device 104 may comprises a mechanical key and a key fob housing transmitter/receiver circuitry and have one or more input means like mechanical buttons or capacitive touch buttons. The first portable device 104 could also be embodied in other means, such as a smart watch, a wristband, etc. so long as it is set-up to communicate with the vehicle 102 as described in detail below. On the other hand, the second portable device 106 preferably is embodied in a wireless device having receiver/transceiver circuitry, a microcontroller or CPU, and a memory, and can store a plurality of passwords for a corresponding plurality of vehicles, and has means to input various commands, as described in detail below.

The vehicle 102 includes an input and display device 108, an access controller 110, a door lock 112, multiple systems/devices—one of which is shown—device 114 (also referred to as "devices 114"), an immobilizer 116, and an ignition system 118. In one embodiment, the first portable device 104 is a key fob that includes a first mechanical key, and the second portable device 106 is a wireless transceiver device such as a mobile phone, a Bluetooth device, a tablet, a phablet, and the like. The first and second portable devices 104 and 106 each include a memory for storing data and commands, such as password data and commands for transmission to the controller 110, encryption/decryption circuitry and wireless transceiver/receiver circuitry, as is known in the art. The controller 110 also includes a memory, encryption/decryption circuitry and wireless transceiver/receiver circuitry, as well as a counter and a comparator, amongst other circuitry, as will be understood by those of skill in the art. The device 114 may be one of a fuel tank, an in-car communication and entertainment system, an air-conditioning system, a storage compartment, an engine, a fuel injector, a braking system, a bonnet, windows, a sunroof, a trunk, a glove compartment, a child lock, and the like. It is envisioned that the owner/authorized user of the vehicle will maintain the first portable device 104 and the valet or service person will be granted access to the second portable device 106. The immobilizer 116 is a security device that verifies whether access to the ignition system 118 is permitted. The immobilizer 116 is connected to the ignition system 118 and outputs an enable ignition signal EN_IG to enable the ignition system 118. Immobilizers and ignitions systems are understood by those of skill in the art so the present invention should not be limited by a particular immobilizer or ignition system. In one embodiment, the immobilizer 116 is incorporated within and is part of the access controller 110. In a presently preferred embodiment, the access controller 110 also is connected to a geo-positioning system (GPS) (not shown).

The first portable device 104 includes an input interface (not shown), which is used by the owner/user to input at least one first trigger signal TRIGGER1. In one embodiment, the input interface includes a button (not shown), which when pushed generates a first trigger signal TRIGGER1. In another embodiment, the input interface includes a set of buttons and when at least one of the set of buttons is pushed, one or more first trigger signals TRIGGER1 are generated. The set of buttons are used to activate the first lock signal LOCK1 and first through third access modes. In yet another embodiment, the input interface is a touch-based interface used to generate the first trigger signal TRIGGER1 by the sense of touch (e.g., capacitive touch sensors). The first portable device 104 generates an access mode signal MODE and a first lock signal LOCK1 based on the at least one first trigger signal TRIGGER1. The first lock signal LOCK1 and the access mode signal MODE are commands issued by the first portable device 104.

In the presently preferred embodiment, the access mode signal MODE indicates one of first through third access modes. The first access mode is a mode in which access to the vehicle 102 is not shared with a third-party (e.g., a valet) and is restricted only to the owner/user. The second access mode is a mode in which access to the vehicle 102 is shared with a third-party (e.g., a valet) based on a shared password for a predetermined time using the second portable device 106. In some embodiments, the third-party will have its own second portable device, which may be a smart generic hand-held device suitable for operating with multiple vehicles supporting systems the like the system 100. The third access mode is a mode in which access to the vehicle 102 is shared with a third-party for a predetermined time, but the first shared password SHARED1, the first unshared password UNSHARED1, and the first and second portable devices 104 and 106 are not shared with the third-party. In the third access mode, the access controller 110 does not respond to any communications from the second portable device 106. It is a pure temporal shared access mode.

The door lock(s) 112 is activated based on the first lock signal LOCK1. In one embodiment, when the first lock signal LOCK1 is active (i.e., at a first logic state), the door lock 112 is activated and the vehicle 102 is locked, and when the first lock signal LOCK1 is inactive (at a second logic state), the door lock 112 is deactivated and the vehicle doors are unlocked. Hence, the first lock signal LOCK1 at the second logic state is also referred to as a first unlock signal. In a first alternative embodiment, when the first lock signal LOCK1 is activated, then the door lock 112 toggles its state. For example, if the doors are locked and LOCK1 is activated, then the doors will unlock, and if the doors are unlocked, the next time LOCK1 is activated then the doors will lock. In another alternative embodiment, LOCK1 includes a first set of bits that form a first bit-pattern that activate the door lock 112, and when LOCK1 includes a second set of bits forming a second bit-pattern, the door lock 112 is deactivated and the vehicle 102 is unlocked. Hence, when the first lock signal LOCK1 includes the second bit-pattern, it is a first unlock signal. The first and second bit-patterns are alternately generated by the first portable device 104. For example, when the owner/user provides the first trigger signal TRIGGER1 and the first portable device 104 generates the first lock signal LOCK1 including the first bit-pattern, the vehicle 102 is locked. After locking the vehicle 102, the next time the first trigger signal TRIGGER1 is issued, the first portable device 104 generates the first lock signal LOCK1 including the second bit-pattern, which unlocks the vehicle 102.

The first portable device 104 also generates a second unshared password UNSHARED2. In one embodiment, the first unshared password UNSHARED1 is predetermined and corresponds to the vehicle 102. The first portable device 104 encrypts the first unshared password UNSHARED1 and transmits it as an encrypted version of the second unshared password UNSHARED2. Hence, the encrypted version of the second unshared password UNSHARED2 also corresponds to the vehicle 102 and is used to mate the vehicle 102 and the first portable device 104. The first portable device 104 uses a known encryption algorithm such as the Advanced Encryption Standard (AES) to encrypt the first unshared password UNSHARED1.

The first portable device 104 also generates and transmits a first location signal LOCATION1. In one embodiment, the first portable device 104 includes an identification tag for generating the first location signal LOCATION1. Examples of identification tags are RFID tags, Bluetooth tags, Wi-Fi tags, and the like. The identification tag operates using a known energy-harvesting technique. Depending on the energy-harvesting technique, the first portable device 104 receives at least one short-range radio frequency (RF) (i.e., low frequency (LF)) signal in the form of a beam from multiple antennas (not shown) positioned at multiple places on the vehicle 102. When an energy level of the RF signal is greater than or equal to a threshold energy level, the first portable device 104 generates the first location signal LOCATION1, which has a signal strength based on the energy level of the RF signal. The energy level of the RF signal and hence, signal strength of the first location signal LOCATION1 increases as the distance between the identification tag (and hence, the first portable device 104) and the antenna(s) decreases, which allows the location of the first portable device 104 with respect to the vehicle 102 to be determined. Thus, the identification tag facilitates detection of the location of the first portable device 104 by the access controller 110 when the distance between the identification tag and the antenna(s) is less than or equal to a threshold distance related to the threshold energy level. Since the first portable device 104 is usually carried by a person, the first location signal LOCATION1 also indicates a location of such person (e.g., the vehicle owner).

The input and display device 108 located in the vehicle 102 is used to input a customization request CSTM_RQ and at least one access control parameter (ACP), indicated with a signal CTRL_PAR, to configure the access controller 110 for providing restricted access to the vehicle 102 in the second and third access modes. The ACPs are values for controlling the operation of the systems/devices 114 and the immobilizer 116. The ACPs may be set, as noted above, using the input and display device 108. In one embodiment, the ACP signal CTRL_PAR includes binary values for enabling or disabling various systems/devices 114 such as the air-conditioning system and the in-car communication and entertainment system and locking or unlocking each of the various storage compartments and the fuel tank. The ACP signal CTRL_PAR also may include decimal values of each of a restricted speed and a restricted distance. In one embodiment, the input and display device 108 includes a set of buttons (not shown) and a display panel (not shown), where the buttons are used to input the customization request and at least one ACP. The display panel displays information such as an alert signal ALERT, a notification, a prompt to provide an ACP value corresponding to a particular system/device 114, and a predetermined time. In another embodiment, the input and display device 108 is a display panel with a touch-based interface. Various examples of the display panel are a liquid crystal display (LCD) panel, a light-emitting diode (LED) display panel, an organic LED (OLED) display panel and the like.

In the presently preferred embodiment, the access controller 110 is connected wirelessly to the first portable device 104 using at least one of a short-distance communication network such as low frequency (LF) or Bluetooth and a long-distance communication network such as an ultra-high frequency communication network (UHF) or Wi-Fi. The access controller 110 also is connected to the input and display device 108.

The access controller 110 receives at least one of the second unshared password UNSHARED2 from the first portable device 104 for verifying the first portable device 104, and a second shared password SHARED2 from the second portable device 106 for verifying the second portable device 106 and the level of vehicle access that will be permitted by commands sent from the first portable device 104 to the access controller 110. In one embodiment, the access controller 110 receives at least one of the access mode signal MODE, the first location signal LOCATION1, and the first lock signal LOCK1 from the first portable device 104 when the device 104 is verified, which is when the second unshared password UNSHARED2 transmitted from the device 104 to the controller 110 matches the first unshared passwords UNSHARED1. In another embodiment, the access controller 110 receives the access mode signal MODE from the input and display device 108, and the first location signal LOCATION1 from the first portable device 104. The access controller 110 also receives a second lock signal LOCK2 from the device 104 when the access mode signal MODE indicates the second access mode and when the first and second shared passwords SHARED1 and SHARED2 match. The access controller 110 stores an identification (ID) number corresponding to the vehicle 102 for identifying the vehicle 102. For example, the ID number may comprise the vehicle registration number. In one scenario, the location signal LOCATION1 is used to determine how far away the portable device 104 is from the access controller 110 and if the device 104 is beyond a certain distance, then the device 104 can be used to unlock the vehicle but not to start the vehicle or use the customization options that grant the second portable device 106 access to the vehicle.

For the following description, it will be assumed that the first portable device 104 has not been misplaced and is with the "owner". Thus, to ensure that the user of the vehicle 102 is the owner, the first portable device 104 must be within a predetermined distance of the vehicle 102. The access controller 110 determines whether the first portable device 104 is within the predetermined distance using the signal strength of the first location signal LOCATION1 transmitted by the first portable device 102. A value for the predetermined distance is stored in the memory of the access controller 110. The access controller 110 identifies the antenna that corresponds to the greatest signal strength of the first location signal LOCATION1 and hence, is nearest to the first portable device 104. In this manner, the access controller 110 determines the direction of the first portable device 104 with respect to the vehicle 102 based on the position of the antenna that identifies the greatest signal strength of the first location signal LOCATION1. For example, the access controller 110 can determine whether the first portable device 104 is located near the front, rear, or sides of the vehicle 102 or whether the device 104 is inside the vehicle 102. In the first access mode, the access controller 110 also receives at least one access control parameter CTRL_PAR based on a customization request CSTM_RQ and the first location signal LOCATION1.

The access controller 110 has the first unshared password UNSHARED1 and a first shared password SHARED1 stored in its memory. The first shared password SHARED1 is stored for the predetermined time. In one embodiment, the access controller 110 generates and transmits the first shared password SHARED1 to the first portable device 104, and later the first portable device 104 transmit SHARED1 to the second portable device 106 (which is used by the second portable device and allows temporary, limited access to the vehicle 102). In another embodiment, the first portable device 104 generates and transmits the first shared password SHARED1 to the access controller 110 and to the second portable device 106. The first shared password SHARED1 is generated using various techniques known in the art such as a random-number generation algorithm. Random number generation algorithms are well-known to those skilled in the art. The first shared password SHARED1 may be a numeric, an alphanumeric, or an American Standard Code for Information Interchange (ASCII)-compatible code.

In one embodiment, the first shared password SHARED1 is generated using the random-number generation algorithm, stored for the predetermined time, and then deleted after the end of predetermined time. However, if the access mode is changed to the first access mode, then the first shared password SHARED1 becomes invalid before the predetermined time has elapsed. In another embodiment, the owner determines the first shared password SHARED1, enters it using the input and display device 108, and stores it in the access controller 110. The access controller 110 may store the first shared password SHARED1 for either an indefinite time or for the predetermined time. When the access controller 110 stores the first shared password SHARED1 for the predetermined time, a new first shared password SHARED1 is input by the owner (via the input device 108) every time the system 100 is operated in the second access mode.

To verify whether a command is received from either the first portable device 104 or the second portable device 106 and control the operation of the door lock 112, the access controller 110 decrypts the second shared and unshared passwords SHARED2 and UNSHARED2 in the second and first access modes of access, respectively. The access controller 110 compares the second unshared password UNSHARED2 with the first unshared password UNSHARED1, using the comparator, in the first access mode, and provides the first lock signal LOCK1 to the door lock 112 based on the comparison result. Similarly, the access controller 110 compares the second shared password SHARED2 with the first shared password SHARED1, again using the comparator, in the second access mode, and provides the second lock signal LOCK2 to the door lock 112 based on the comparison result. The access controller 110 includes a counter (timer) used to determine when the predetermined time has elapsed and that generates a time-out signal thereafter, and then the access controller 110 generates a third lock signal LOCK3 based on the time-out signal. In one embodiment, the third lock signal LOCK3 includes the first bit-pattern. The second and third lock signals LOCK2 and LOCK3 are similar to the first lock signal LOCK1.

To control the operation of the device 114 and the immobilizer 116, the access controller 110 generates at least one control output signal CTRL_OUT and an ignition control signal CTRL_IG, respectively, based on a corresponding CTRL_PAR signal, the access mode signal MODE, and the comparison result between the first and second shared passwords SHARED1 and SHARED2.

The second portable device 106 is wirelessly connected to the access controller 110 and the first portable device 104. The first and second portable devices 104 and 106 may communicate with each other using long-distance communication networks such as the second generation (2G), third generation (3G), long-term evolution (LTE), and Wi-Fi networks. The second portable device 106 receives and stores the ID number and the first shared password SHARED1. The second portable device 106 also generates the second lock signal LOCK2 based on a second trigger signal TRIGGER2 initiated by a manual input to the second portable device 106 in a similar way to the generation of the first lock signal LOCK1 by the first portable device 104. In one embodiment, an input interface (not shown) of the second portable device 106 includes one or more buttons, which when pushed generate the second trigger signal TRIGGER2. In another embodiment, the input interface is a touch-based interface (e.g., capacitive touch sensors) used to generate the second trigger signal TRIGGER2. The second portable device 106 stores the vehicle ID number and a corresponding location of the vehicle 102. The second portable device 106 encrypts the first shared password SHARED1 and transmits it as the second shared password SHARED2 to the controller 110. The second portable device 106 also transmits the second lock signal LOCK2 to the controller 110.

In a presently preferred embodiment, during factory initialization of the vehicle 102, the first unshared password UNSHARED1 is stored in the memories of both the access controller 110 and the first portable device 104. The system 100 is in the first access mode. It is assumed that the owner of the vehicle 102 will maintain the first portable device 104 in close proximity to him/herself. After the factory initialization, a button on the first portable device 104 is used to activate the first trigger signal TRIGGER1 in order to either access the vehicle 102 or configure the access controller 110. In response to the first trigger signal TRIGGER1, the first portable device 104 generates and transmits the second unshared password UNSHARED2 and the command to the access controller 110. The command is at least one of the first lock signal LOCK1 and the customization request CSTM_RQ. Since the system 100 is in the first access mode, the access controller 110 verifies the second unshared password UNSHARED2 by comparing the first and second unshared passwords. If the passwords do not match, then the access controller 110 does not process the command, and the vehicle 102 remains locked; and if passwords match, then the access controller 110 will execute the command.

The executed command is the first lock signal LOCK1, based on the first trigger signal TRIGGER1, which locks or unlocks the vehicle 102, as the case may be, in the first access mode. When the first lock signal LOCK1 includes the first bit-pattern, the access controller 110 activates the door lock 112, which locks the vehicle 102. The vehicle 102 remains locked until it receives a command and the second unshared password UNSHARED2 from the first portable device 104. When the first lock signal LOCK1 includes the second bit-pattern (referred to as the first unlock signal), the access controller 110 deactivates the door lock 112, which unlocks the vehicle door(s). The first portable device 104 also is used to enable the ignition system 118. The vehicle 102 then remains unlocked in the first access mode until the access controller 110 receives either the customization request CSTM_RQ for configuring the access controller 110 from the input and display device 108 or the command along with the second unshared password UNSHARED2 for locking the vehicle 102 from the first portable device 104. Note, the previous scenario does not prevent the doors from being otherwise locked such as automatically locking the doors when an interior door-lock button is pressed or when the vehicle is placed in gear and attains a predetermined speed or has been in gear for a predetermined time.

In another embodiment, after the verification of the portable device 104, the access controller 110 is configured for controlling access to the vehicle 102 in the first access mode. A user of the vehicle 102 inputs the customization request CSTM_RQ by way of the input and display device 108. To ensure that the user of the vehicle 102 is the "owner", the first portable device 104 transmits the first location signal LOCATION1 when it is within the threshold distance of the vehicle 102 based on the aforementioned energy-harvesting technique. The access controller 110 detects the first location signal LOCATION1 and determines the location of the first portable device 104. If the first portable device 104 is within the threshold distance of the vehicle 102, based on the first location signal LOCATION1, then the controller 110 will process the customization request CSTM_RQ. The access controller 110 uses the comparator to compare the distance of the first portable device 104 and the vehicle 102 with the predetermined distance. If the first portable device 104 is not within the predetermined distance of the vehicle 102, then the controller 110 will not process the customization request CSTM_RQ, and will instead generate the alert signal ALERT and display it on the display panel of the input and display device 108. In a presently preferred embodiment, the access controller 110 also will deny the input of further commands or data from the input device 108.

When the first portable device 104 is within the predetermined distance, then the access controller 110 displays a prompt or a field on the input and display device 108 for the input of at least one access control parameter CTRL_PAR, which will control an operation of the device 114. In one example, a set of access control parameters CTRL_PAR is input to disable the in-car entertainment and communication system and the air-conditioning system, lock the storage compartment, and the fuel tank, and restrict the speed the vehicle 102 may go and restrict the distance the vehicle 102 may travel to predetermined values. The restricted speed and distance may be pre-set at the factory or input by the user. For example, the restricted distance may be set to a maximum distance for which a valet may drive the vehicle 102 to park it in the parking area. Different sets of access control parameters CTRL_PAR may be stored in the controller to facilitate selection, instead of having to enter values each time. For example, there may be one setting for restaurant parking, and another setting for service-station usage.

In one embodiment, after the verification of the portable device 104, in order to change the access mode from the first access mode to the second access mode, the first trigger signal TRIGGER1 is activated using the first portable device 104, which will generate the access mode signal MODE to indicate the second access mode. The access mode signal MODE is generated when the "owner" wants to share access to the vehicle 102 with a valet for parking the vehicle 102. During drop-off of the vehicle 102 at the valet parking area, the first portable device 104 transmits the access mode signal MODE to the access controller 110. The access controller 110 determines whether the access mode signal MODE is indicating the second or third access mode. The access controller 110 generates the first shared password SHARED1 and transmits the first shared password SHARED1 to the second portable device 106 by way of the first portable device 104.

After changing the access mode to the second access mode, the controller 110 starts counting down with the counter to determine the end of the predetermined time. If neither the owner nor the valet access the vehicle 102 within the predetermined time, using either the first or second portable devices 104 and 106, respectively, then the controller 110 will generate the time-out signal. However, during the predetermined time, when the valet requires the access to the vehicle 102, the valet initiates the second trigger signal TRIGGER2 using the second portable device 106 to generate the second lock signal LOCK2 and transmit it along with the second shared password SHARED2 to the access controller 110.

The access controller 110 receives the second shared password SHARED2 and compares it with the first shared password SHARED1 using the comparator. If these passwords do not match, then the access controller 110 will not deactivate the door lock 112 and the vehicle 102 remains locked. If these passwords do match, then the access controller 110 processes the second lock signal LOCK2 and causes the vehicle doors to be unlocked. In one embodiment, the access controller 110 deactivates the door lock 112 of only one door of the vehicle 102 instead of deactivating the door lock 112 of all the doors of the vehicle 102.

The access controller 110 also generates at least one control output signal CTRL_OUT and the ignition control signal CTRL_IG corresponding to the at least one access control parameter CTRL_PAR. The at least one control output signal CTRL_OUT controls the operation of the device 114. For example, the access controller 110 generates first through fourth control output signals CTRL_OUT1-CTRL_OUT4 and the ignition control signal CTRL_IG based on first through fifth access control parameters CTRL_ PAR1-CTRL_PAR5. The access controller 110 outputs the first through fourth control output signals CTRL_OUT1-CTRL_OUT4 to the in-car communication and entertainment system, the air-conditioning system, the storage compartment, and the fuel tank, respectively, which disables the in-car communication and entertainment system and the air-conditioning system, and locks the storage compartment and the fuel tank. The access controller 110 outputs the ignition control signal CTRL_IG to the immobilizer 116 to output the enable ignition signal EN_IG, which enables the ignition system 118 and allows the vehicle to be started. In one embodiment, the immobilizer 116 controls an ignition current to the ignition system 118 and a quantity and a rate of fuel supplied to the engine when the first portable device 104 is not proximate to the controller 110 (i.e., outside of the predetermined distance), thereby restricting the engine RPMs (revolutions per minute) to a threshold value, which in turn restricts the speed and the distance the vehicle 102 may travel. If the restricted distance is travelled, the restricted speed is reached, or the predetermined time elapses, then the access controller 110 will transmit an alarm signal to the first portable device 104. Other actions also could be initiated with the alarm signal, such as switch off and/or disabling the ignition system 118, deflating one or more of the tires, and activating visual and/or audio alerts at the vehicle such as flashing the lights on/off repeatedly and sounding an alarm; the alarm signal also trigger a call to a vehicle tracking system.

In one embodiment, the access controller 110 enables the ignition system 118 using a button. In another embodiment, the vehicle 102 is not enabled with the button mechanism. Hence, a second mechanical key, which is a dumb device (i.e., a second mechanical key without a processor, an identification tag, and a wireless transceiver), may be used to enable the ignition system 118. Such a second mechanical key preferable only allows access to the vehicle when the vehicle is in valet mode (second access mode), in which case the second mechanical key could be stored in a storage compartment (not shown) of the vehicle 102. In yet another embodiment, the first portable device 104 includes a detachable second mechanical key, which is different from the first mechanical key, and only enables the ignition system 118. In this scenario, the access controller 110 enables the ignition system 118 without the first portable device 104 when the access mode signal MODE indicates the second access mode. Devices 114 such as the trunk and the storage compartment, which may be accessed by the first portable device 104, would not be accessible with the detachable second mechanical key i.e., cannot be unlocked using the second mechanical key.

When the operation of the device 114 is controlled, i.e., when the in-car communication and entertainment system and the air-conditioning system are disabled, the storage compartment and the fuel tank are locked, the engine RPMs is restricted, and the speed and the distance the vehicle 102 may travel are restricted, it is referred to as a 'limited access' to the vehicle 102. Thus, the access controller 110 provides the valet limited access to the vehicle 102. The valet may drive the vehicle 102 to the parking area and park the vehicle 102 within the predetermined time, and fetch and return the vehicle within the predetermined time. The input and display device 108 located within the vehicle 102 displays the time available before the predetermined time ends. In one embodiment, the first portable device 104 also has a display area that displays the counting down of the predetermined time and the current mode. The display also can display other information such as distance from the vehicle.

Before the predetermined time ends, when the valet provides the second trigger signal TRIGGER2 to the second portable device 106 (i.e., pushes a button on the second portable device 106), then the second portable device 106 will generate and transmit the second shared password SHARED2 and the second lock signal LOCK2 including the first bit-pattern, to the access controller 110. The access controller 110 will verify the second portable device 106 by comparing the first and second shared passwords SHARED1 and SHARED2. If the first and second shared passwords SHARED1 and SHARED2 do not match, the vehicle 102 will not process any commands received from the second portable device 106, and when the first and second shared passwords SHARED1 and SHARED2 match, the access controller 110 will process the second lock signal LOCK2. For instance, locking the doors after parking, or unlocking the doors when fetching the vehicle 102.

After the predetermined time has ended, the first and second shared passwords expire and hence, cannot be used to access the vehicle 102 in the second access mode. Further, the access controller 110 determines whether the vehicle 102 is locked. If the access controller 110 determines that the second trigger signal TRIGGER2 has not been provided (i.e., the access controller 110 does not receive the second lock signal LOCK2), then the access controller 110 will generate the third lock signal LOCK3 including the first bit-pattern and lock the vehicle 102, and switch off the ignition system 118.

After the valet parks the vehicle 102, the location of the parked vehicle 102 and its corresponding ID number are stored in the second portable device 106 to assist the valet or user of the second portable device 106 in locating the car when it is time for pick-up. In one embodiment, the valet manually enters and stores the ID number and the corresponding location of the parked vehicle 102 in the second portable device 106. In another embodiment, the GPS of the vehicle 102 generates a location signal that is transmitted to and read by the second portable device 106, which receives and stores this location signal. In yet another embodiment, the vehicle 102 has a plate with the ID number stamped therein that can be scanned and read using the second portable device 106 to store the ID number in the memory of the second portable device 106.

Although the controller 110 is in the second access mode (valet mode), after drop-off and before pick-up, the first portable device 104 can still be used to access the vehicle, independent of the second portable device 106, by providing the first trigger signal TRIGGER1 to the first portable device 104, which transmits the second unshared password UNSHARED2 and the first lock signal LOCK1 to the controller 110. The access controller 110 receives the second unshared password UNSHARED2 and the first lock signal LOCK1 including the second bit-pattern as a command, compares the passwords and if they match, processes the command. If the first and second unshared passwords UNSHARED1 and UNSHARED2 do not match, then the vehicle 102 remains in the second access mode and does not process the first command, i.e., the first lock signal LOCK1.

For pick-up of the vehicle 102, the first trigger signal TRIGGER1 is activated at the first portable device 104 to generate a pick-up signal that is sent to the second portable device 106. In one scenario, the vehicle owner approaches the valet area and when within a predetermined range, triggers the pick-up signal, where the predetermined range allows the pick-up signal to be transmitted to and received by the second portable device 106 using short-range communications methods such as short range RF signals, Bluetooth, near field communications (NFC), and LF communications. In another embodiment, a separate device, such as a cell phone is used to send the pick-up signal to the second portable device 106. In yet another embodiment, the first portable device 104 is more sophisticated (e.g., a mobile phone with a vehicle key fob app), then the pick-up signal is transmitted from the first portable device 104 to the second portable device 106 using long-distance communication networks such as second generation (2G), third generation (3G), long-term evolution (LTE) network, and Wi-Fi. For example, the second portable device 106 may receive the pick-up signal as a short-message service (SMS) or a notification using a mobile application dedicated to a parking facility of the parking area. The notification or the SMS includes the ID number of the vehicle 102. The pick-up signal itself may be a notification including the ID number of the vehicle 102. The second portable device 106 determines the location of the vehicle 102 by reading the in the memory and indexed with the ID number of the vehicle 102, for example.

After transmission of the pick-up signal, the first portable device 104 generates and transmits a new first shared password SHARED1 to the access controller 110 and the second portable device 106. The second portable device 106 transmits the new first shared password SHARED1 as a new second shared password SHARED2 to the access controller 110. The second portable device 106 transmits the second lock signal LOCK2 including the second bit pattern to the access controller 110. When the new second shared password SHARED2 matches the new first shared password SHARED1, the access controller 110 enables commands received from the second portable device 106 to be processed in line with the second access mode. In another embodiment, in a third access mode that enables pick-up, the first portable device 104 transmits to the access controller 110 the first unshared password UNSHARED1 and the first command to unlock the vehicle 102. Thus, the valet can access the vehicle 102, enable the ignition system 118 without the first portable device 104, and drive from the parking area to the location of the owner. The valet then locks the vehicle 102 by providing the second trigger signal TRIGGER2 to the second portable device 106, which generates and transmits the second shared password SHARED2 and the second lock signal LOCK2 including the first bit-pattern. The access controller 110 compares the first and second shared passwords SHARED1 and SHARED2 to verify the second shared device 106. If the first and second shared passwords SHARED1 and SHARED2 match, the access controller 110 activates the door lock 112 based on the second lock signal LOCK2. The valet then hands over the vehicle 102 to the owner. If the first and second shared passwords SHARED1 and SHARED2 do not match or if the valet fails to provide the second trigger signal TRIGGER2 and leaves the vehicle 102 unlocked, the access controller 110 generates the third lock signal LOCK3 after a predetermined time has elapsed, thereby, automatically locking the vehicle 102. The first portable device 104 then should be used to operate the system 100 in the first access mode and unlock the vehicle 102. In the scenario where the shared passwords do not match, the vehicle 102 cannot be unlocked using the second portable device 106.

In another embodiment, after verification of the first portable device 104, to change the access mode to the third access mode, the first trigger signal is provided to the first portable device 104 to generate the access mode signal MODE indicating the third access mode. The first portable device 104 is used to provide the access mode signal MODE when the owner wants to share access to the vehicle 102 with a valet or other person for temporary usage. During vehicle drop-off, the first portable device 104 transmits the access mode signal MODE to the access controller 110. The access controller 110 determines whether the command is the access mode signal MODE indicating either the second or the third access modes. The access controller 110 generates the first shared password SHARED1 and transmits the first shared password SHARED1 to the second portable device 106 by way of the first portable device 104. Since the access mode signal MODE indicates the third access mode, the access controller 110 operates the system 100 in the third access mode. The access controller 110 deactivates the door lock 112. The input and display device 108 displays the time remaining before the predetermined time ends.

Further, the access controller 110 generates at least one control output signal CTRL_OUT and the ignition control signal CTRL_IG corresponding to the at least one access control parameter CTRL_PAR. The control output signal CTRL_OUT controls the operation of the devices/systems 114 and the ignition control signal CTRL_IG controls the operation of the immobilizer 116 and consequently that of the ignition system 118. The access controller 110 enables the ignition system 118 so that the vehicle 102 can be started using a push-button, a second mechanical key or a detachable second mechanical key (i.e., detachable from the first portable device 104). Thus, the access controller 110 provides the valet limited access to the vehicle 102 and the device 114. The valet then can drive the vehicle 102 to the parking area, parks it, and pick it up during the predetermined interval of time. The access controller 110 detects when the predetermined time ends using a timer.

Once the predetermined time has ended, the access controller 110 turns off the ignition system 118 and generates the third lock signal LOCK3 including the first bit-pattern, which locks the vehicle 102. The valet stores the ID number of the vehicle 102 and its location in the parking area in the second portable device 106 either manually or using the GPS of the vehicle 102. This valet mode can operate in at least two ways. In the first way, the predetermined time only allows the valet to park the vehicle and goes to second access mode lock state when the predetermined time has elapsed. Then the valet will need a shared password and the second portable device 106 to retrieve the vehicle 102. In the second way, the valet can access the vehicle during drop-off and pick-up—that is, the timer is set to a longer time period, e.g., 3 hours, whereas in the first way the timer is set to a short time period, such as 10 minutes. The time period is programmable and may be set using the input and display device 108. After the drop-off and before the pick-up of the vehicle 102, if the owner wishes to access the vehicle 102 independent of the valet, the owner provides the first trigger signal TRIGGER1 to the first portable device 104 to generate and transmit the second unshared password UNSHARED2 and the first lock signal LOCK1 including the second bit-pattern to the access controller 110. The access controller 110 compares the first and second unshared passwords UNSHARED2 and if they match, deactivates the door lock 112 based on the first lock signal LOCK1. The ignition system 118 then can be enabled using the first portable device 104.

During the pick-up of the vehicle 102, the owner provides the first trigger signal TRIGGER1 to the first portable device 104 to generate a pick-up signal (not shown). The first portable device 104 transmits the pick-up signal including the ID number to the second portable device 106. The second portable device 106 determines the location of the vehicle 102 (stored in its memory and corresponding to the ID number of the vehicle 102). After the transmission of the pick-up signal from the first portable device 104 to the second portable device 106, the valet locates the vehicle 102 based on its location stored in the portable device 106 memory. The valet then provides the second trigger TRIGGER2 to the second portable device 106 to generate and transmit the second shared password SHARED2 and the second lock signal LOCK2 including the second bit-pattern to the access controller 110. If the second shared password SHARED2 matches the first shared password SHARED1, then the access controller 110 processes the second lock signal LOCK2, which in this case allows the valet to access the vehicle 102, enables the ignition system 118, and allows the car to be driven from the parking area to the location of the owner. The valet then provides the second trigger signal TRIGGER2 to the second portable device 106, which generates the second shared password SHARED2 and the second lock signal LOCK2 including the first bit-pattern. The access controller 110 compares these passwords and if they match processes the second lock signal LOCK2, which locks the vehicle 102. The valet then hands over the vehicle 102 to the owner. If the valet does not lock the vehicle 102, the access controller 110 locks the vehicle 102 by generating the third lock signal LOCK3 after a predetermined time. The vehicle 102 can then be unlocked using the first lock signal LOCK1 from first portable device 104.

Referring now to FIGS. 2A-2E, a flow chart illustrating a method for controlling access to the vehicle 102 in accordance with an embodiment of the present invention is shown. At step 202, during factory initialization of the vehicle 102, the first unshared password UNSHARED1 is stored in the access controller 110 and the first portable device 104, and the system 100 is initialized to operate in the first access mode.

Figure 2A:
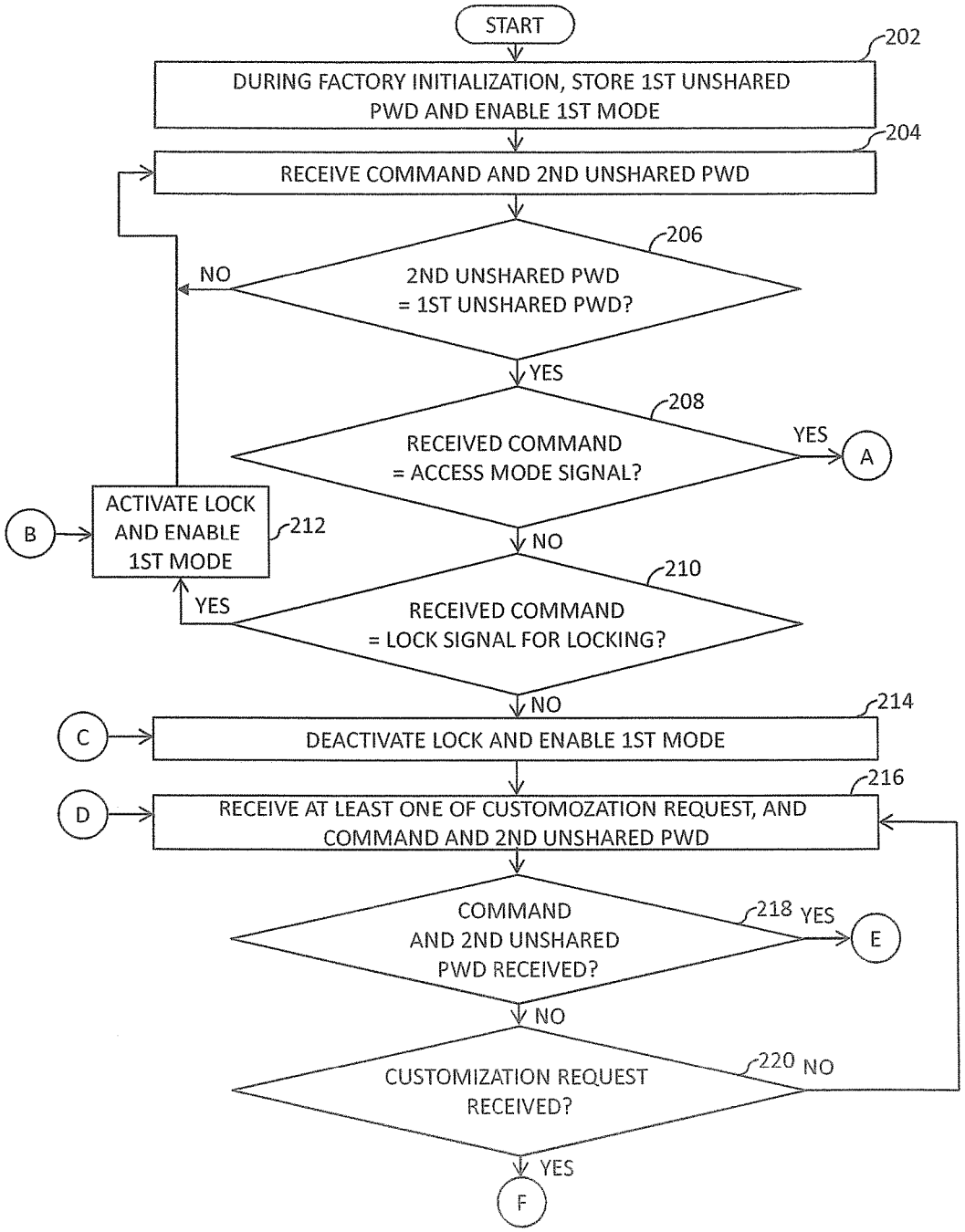
FIGS. 2A, 2B, 2C, 2D, and 2E are a flow chart of a method for controlling access to the vehicle of FIG. 1 in accordance with an embodiment of the present invention.
Figure 2B:
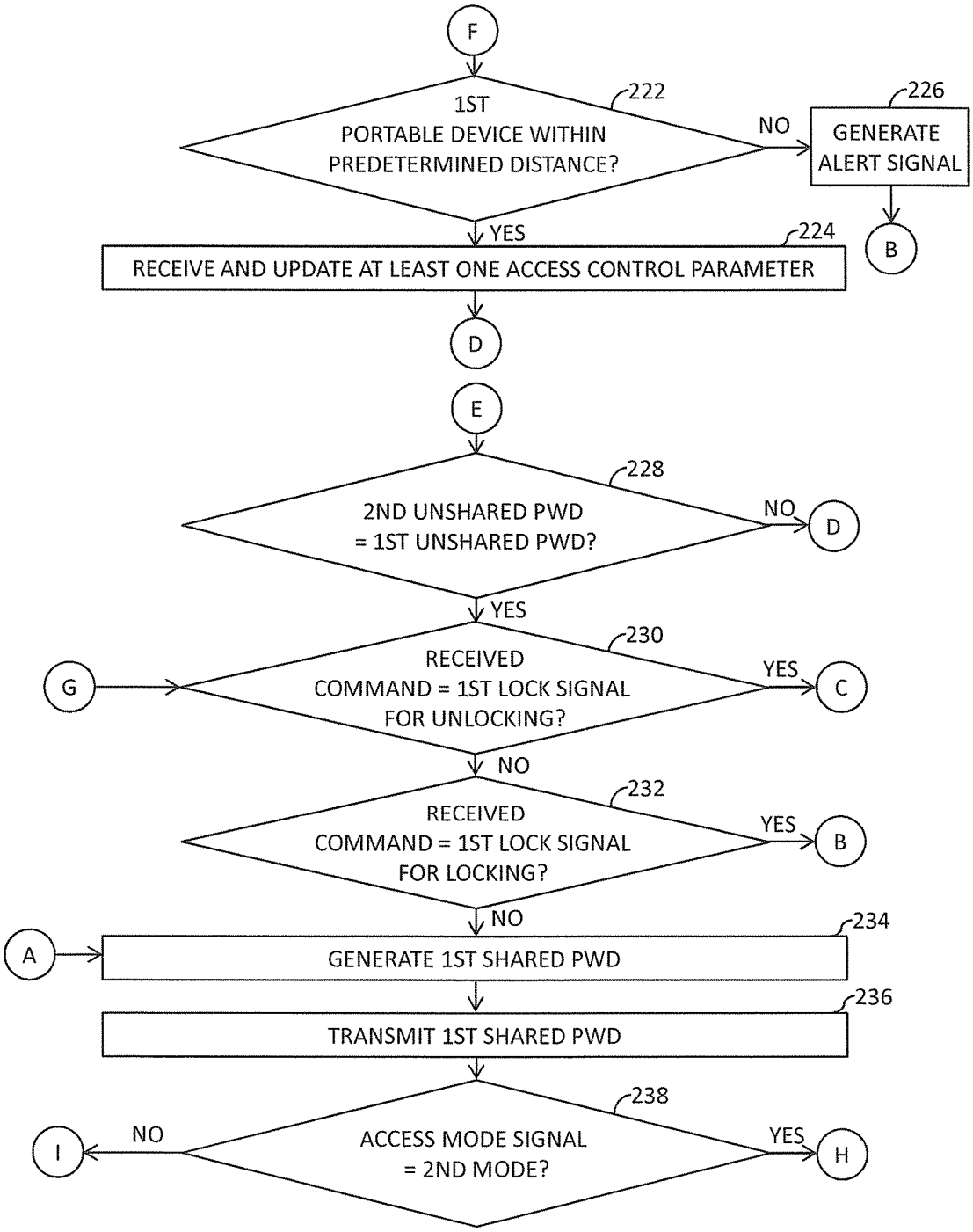
Figure 2C:
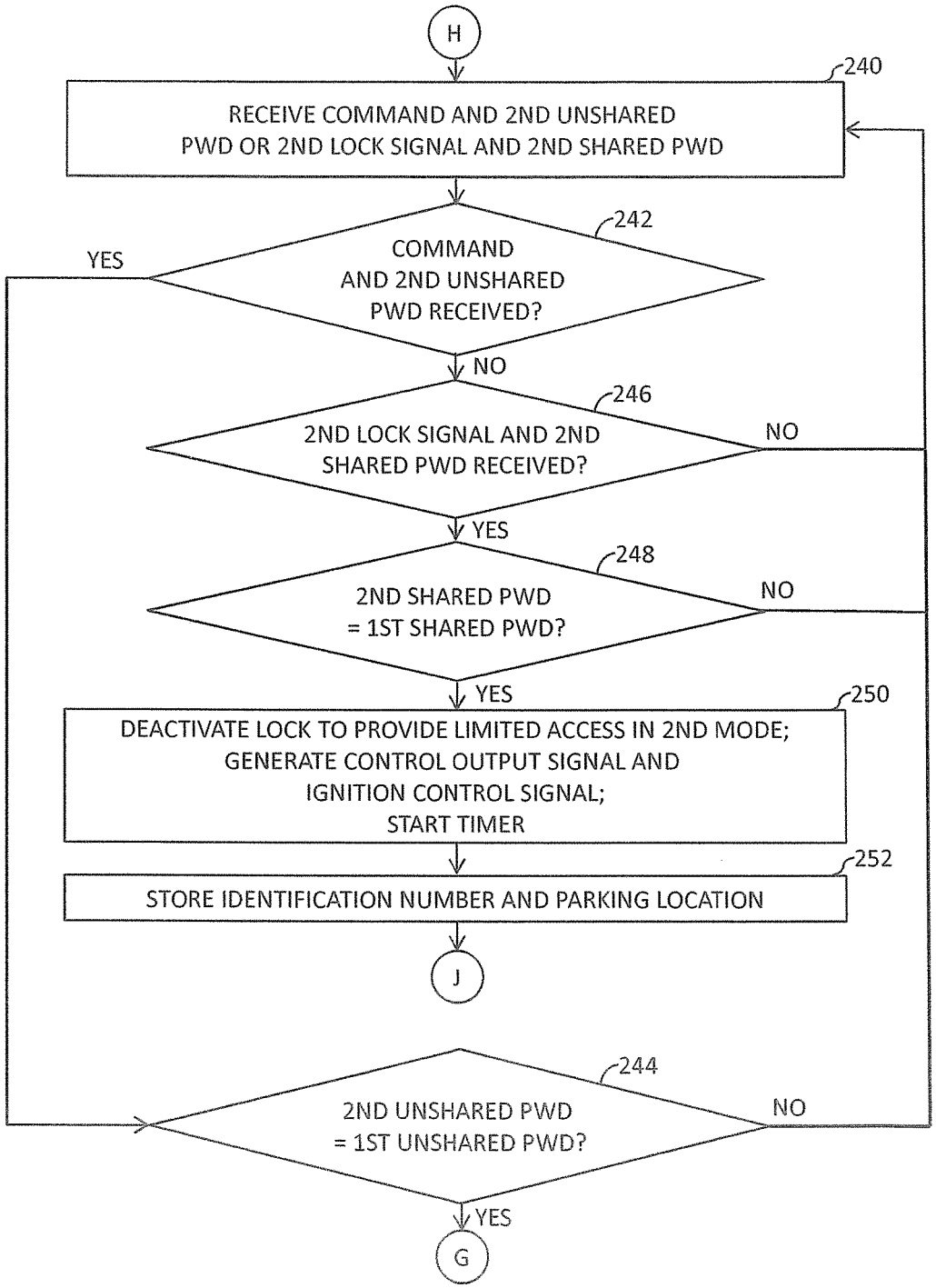
Figure 2D:
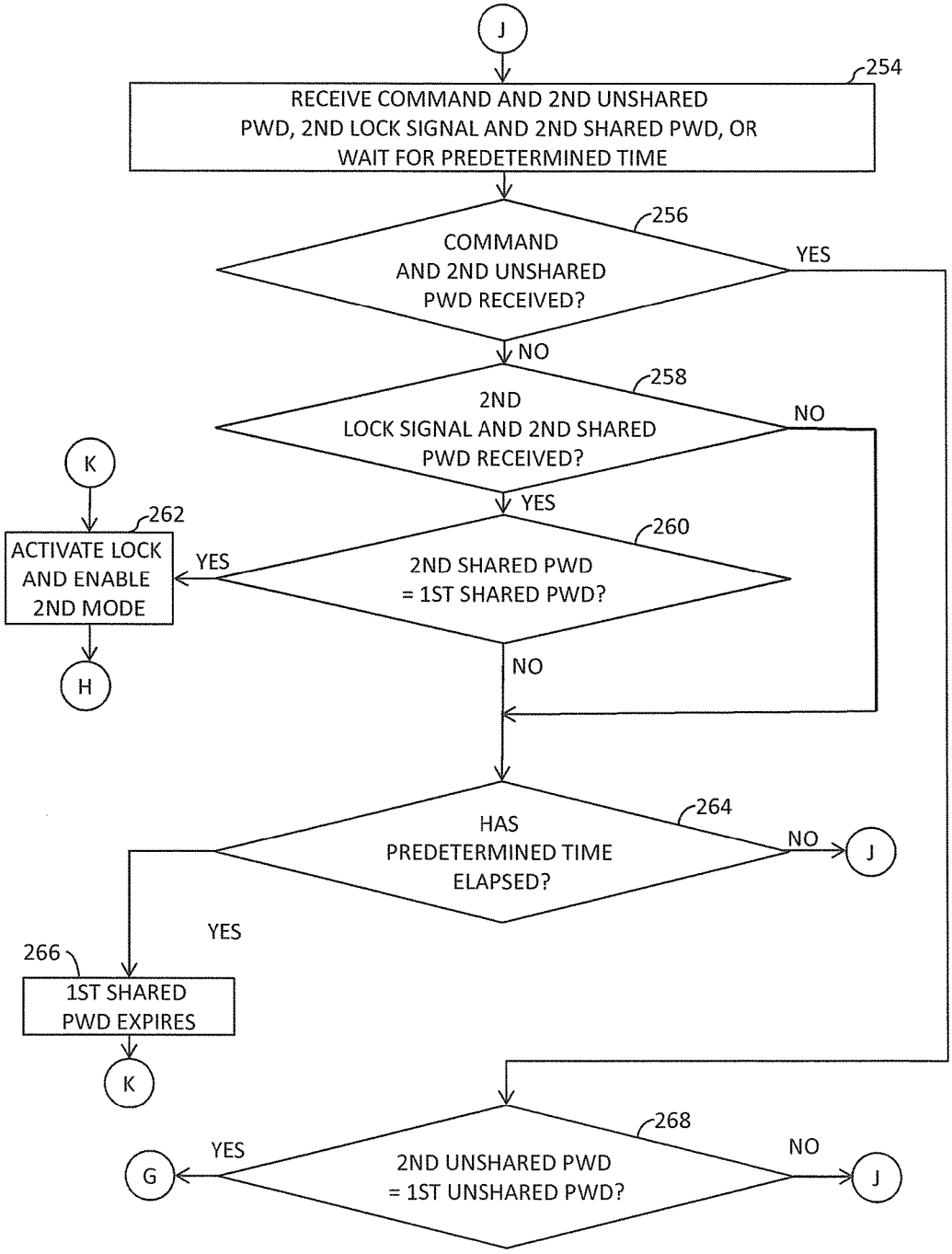

At step 204, the access controller 110 receives the command and the second unshared password UNSHARED2. At step 206, the access controller 110 determines whether the second unshared password UNSHARED2 matches the first unshared password UNSHARED1. If the access controller 110 determines that the first and second unshared passwords do not match, then the access controller 110 loops back to step 204. If the first and second unshared passwords do match, then the access controller 110 proceeds to step 208. At step 208, the access controller 110 determines whether the command is the first access mode signal MODE. If the access controller 110 determines that the command is not the first access mode signal MODE, then the access controller 110 proceeds to step 210, and if the access controller 110 determines that the command is the first access mode signal MODE, then the access controller 110 proceeds to step 234 (FIG. 2B).

At step 210, the access controller 110 checks whether the command is the first lock signal LOCK1, and if yes, the access controller 110 proceeds to step 212. At step 212, the access controller 110 activates the door lock 112, places the system 100 in the first access mode, and then returns to step 204. At step 210, if the access controller 110 determines that the command is not the first lock signal LOCK1, then the access controller 110 proceeds to step 214. At step 214, the access controller 110 deactivates the door lock 112, sets the system 100 in the first access mode, and proceeds to step 216.

At step 216, the access controller 110 receives at least one of the customization request CSTM_RQ from the input and display device 108, and the second unshared password UNSHARED2, and the command from the first portable device 104. At step 218, the access controller 110 determines whether the command and the second unshared password UNSHARED2 have been received. If yes, then the method moves to step 228 (FIG. 2B), and if no, then the access controller 110 performs step 220. At step 220, the access controller 110 checks whether the customization request CSTM_RQ has been received. If no, then the process loops back to step 216, and if yes, the access controller 110 proceeds to step 222 (FIG. 2B).

At step 222, the access controller 110 checks whether the first portable device 104 is within the predetermined distance from the vehicle 102. If yes, then the access controller 110 proceeds to step 224, and if no, the access controller 110 proceeds with step 226. At step 224, the access controller 110 receives and updates at least one control parameter input at the input device 108 for configuring the access controller 110 to control the access to the vehicle 102. Otherwise at step 226, the access controller 110 generates the alert signal ALERT. After generating the alert signal ALERT, the access controller 110 locks the vehicle 102 by performing step 212.

If at step 218, the access controller 110 determined that the command and the second unshared password UNSHARED2 were received, the access controller 110 proceeds to step 228. At step 228, the access controller 110 checks whether the second unshared password UNSHARED2 matches the first unshared password UNSHARED1, and if no, then the procedure loops back to step 216. On the other hand, if the unshared passwords do match, then the access controller 110 performs step 230.

At step 230, the access controller 110 determines whether the command is the first lock signal for unlocking the door lock 112. If the command is the first lock signal for unlocking the door lock 112, the access controller 110 goes to step 214 (FIG. 2A), otherwise step 232 is performed. At step 232, the access controller 110 determines whether the command is the first lock signal for locking (as opposed to unlocking) the door lock 112, and if so, then the access controller 110 locks the vehicle 102 by performing step 212 (FIG. 2A); otherwise the access controller 110 proceeds to step 234.

Figure 2E:
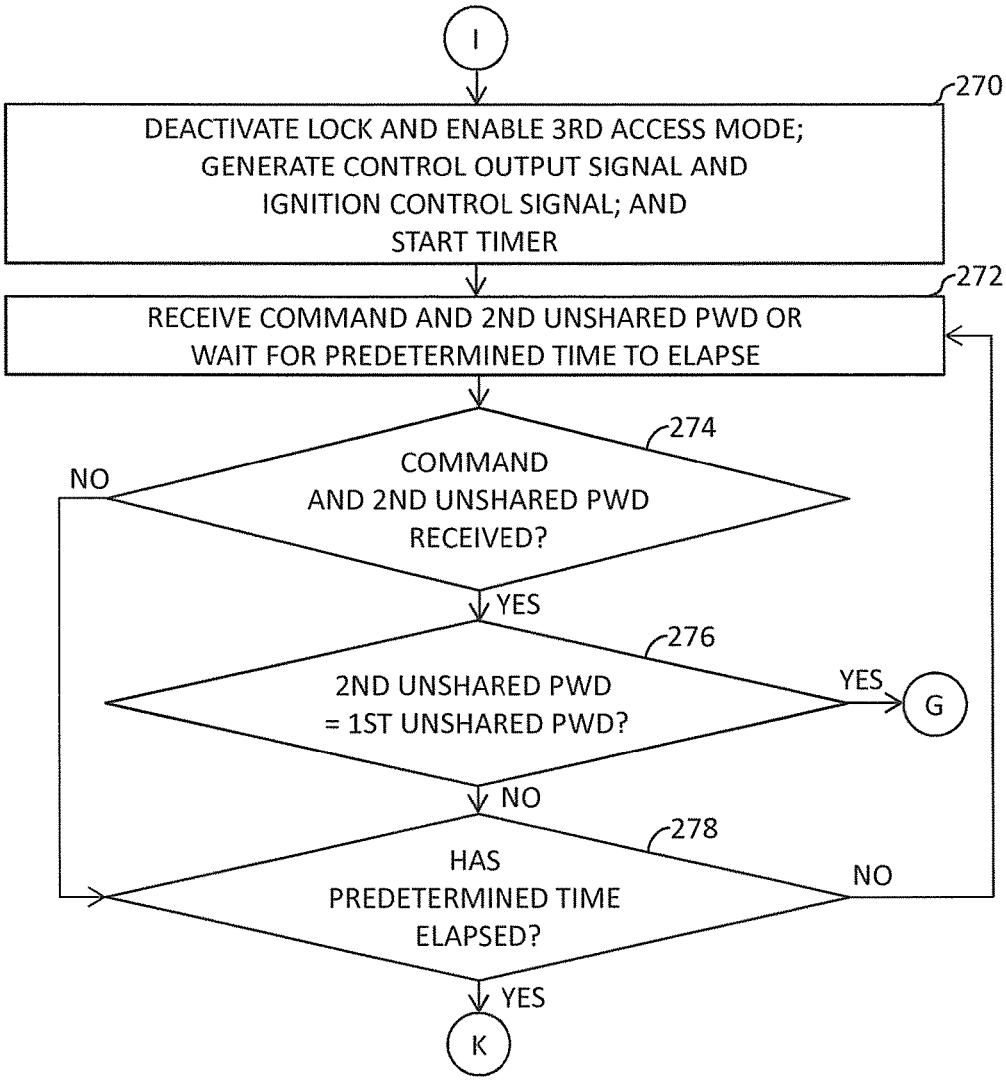

At step 234, a first shared password SHARED1 is generated by either the access controller 110 or the first portable device 104. In a first scenario, when the access controller 110 receives an access mode change request from either the first portable device 104 or the input and display device 108, then the access controller 110 generates the first shared password SHARED1, stores it in its memory, and transmits it to the first portable device 104; and the first portable device 104 stores the received first shared password SHARED1 in its own memory. In a second scenario, the first shared password SHARED1 is generated by the first portable device 104 when the first portable device 104 receives a trigger signal (i.e., a user presses a button on the first portable device 104) and transmit it to access controller 110, which stores the received first shared password SHARED1 in its own memory. At step 236, the first portable device 104 transmits the first shared password SHARED1 to the second portable device in response to another trigger signal (i.e., a user presses a button on the first portable device 104) for sharing access with a valet. The second portable device, upon receiving the first shared password SHARED1, will store SHARED1 in its own memory and later transmit it as the second shared password SHARED2 to the access controller 110, such as when the valet needs to access the vehicle 102 as in steps 240 and 254. At step 238, the access controller 110 determines whether the command is the access mode signal MODE that indicates the second access mode, and if yes, the access controller 110 performs step 240, and if not, the access controller 110 jumps to step 270 (FIG. 2E).

At step 240, the access controller 110 receives at least one first command and the second unshared password UNSHARED2 from the first portable device 104, and the second lock signal LOCK2 and the second shared password SHARED2 from the second portable device 106. At step 242, the access controller 110 determines whether the command and the second unshared password UNSHARED2 have been received, and if yes, the access controller 110 performs step 244. At step 244 the access controller checks if the first and second unshared passwords match, and if there is a match, then the access controller 110 loops back to step 230 (FIG. 2B); and if these passwords do not match, then the access controller 110 proceeds to step 240.

If at step 242, the access controller 110 determines that the command and the second unshared password UNSHARED2 were not received, then the access controller 110 performs step 246. At step 246, the access controller 110 determines whether the second lock signal LOCK2 and the second shared password SHARED2 have been received, and if yes, the access controller 110 proceeds to step 248, and if not, returns to step 240. At step 248, the access controller 110 checks whether the first and second shared passwords match, and if they do not match, the access controller 110 loops back to step 240, and if these passwords do match, the access controller 110 proceeds to step 250.

At step 250, the access controller 110 deactivates the door lock 112 and places the system 100 in the second access mode. The access controller 110 generates the control output signal and the ignition control signal, and starts the timer. At step 252, the second portable device 106 stores the vehicle identification number and the location of the vehicle 102 (i.e., where it is parked. The second portable device 106 stores this information when it receives a trigger signal such as a button being pressed on the second portable device 106.

At step 254, the access controller 110 receives at least one first command and the second unshared password UNSHARED2 from first portable device 104, and the second lock signal LOCK2 and the second shared password SHARED2 from second portable device 106, and the timeout signal from the timer. At step 256, the access controller 110 determines whether the command and the second unshared password UNSHARED2 have been received. If at step 256, the access controller 110 determines that the command and the second unshared password UNSHARED2 were not received, the access controller 110 goes to step 258. At step 258, the access controller 110 determines whether the second lock signal LOCK2 and the second shared password SHARED2 have been received, and if yes, then the access controller 110 performs step 260. At step 260, the access controller 110 determines whether the second shared password SHARED2 is equal to the first shared password SHARED1, and if these passwords match, then the access controller 110 goes to step 262. At step 262, the access controller 110 activates the door lock 112, sets the system 100 in the second access mode, and then performs step 240.

If at step 258, the access controller 110 determines that the second lock signal LOCK2 and the second shared password SHARED2 have not been received, the access controller 110 goes to step 264. If at step 260, the access controller 110 determines that the first and second shared passwords do not match, then the access controller 110 also performs step 264. At step 264, the access controller 110 checks whether the predetermined time has elapsed by checking whether the timer indicates a time greater than or equal to the predetermined time. If the timer indicates that the time is greater than or equal to the predetermined time, then the access controller 110 proceeds to step 266 (predetermined time has expired). At step 266, the first shared password SHARED1 is marked as expired, and then the access controller 110 activates the door lock 112 by performing step 262. If the predetermined time has not elapsed, then the access controller 110 loops back to step 254.

If at step 256, the access controller 110 determines that the command and the second unshared password UNSHARED2 were received, the access controller 110 performs step 268. At step 268, the access controller 110 checks whether the first and second unshared passwords match, and if they do match, proceeds to step 230, and if they do not match, goes to step 254.

If at step 238, the access controller 110 determines that the command is not the access mode signal MODE indicating the second access mode, then the access controller 110 goes to step 270 (FIG. 2E). At step 270, the access controller 110 deactivates the door lock 112 and places the system 100 in the third access mode. The access controller 110 also generates at least one control output signal CTRL_OUT and the ignition control signal CTRL_IG, and starts the timer.

At step 272, the access controller 110 receives at least one command, the second unshared password UNSHARED2, and the time-out signal from the first portable device 108. At step 274, the access controller 110 determines whether the command and the second unshared password UNSHARED2 were received, and if yes, they were received, then the access controller 110 goes to step 276. At step 276, the access controller 110 determines whether the first and second unshared passwords match, and if they do match, then the access controller 110 proceeds to step 230 (FIG. 2B); and if these passwords do not match, then the access controller 110 performs step 278.

If at step 274, the access controller 110 determines that the command and the second unshared password UNSHARED2 were not received, then the access controller 110 also performs step 278. At step 278, the access controller 110 checks whether the predetermined time has expired. If the predetermined time has elapsed, then the access controller 110 performs step 262, and if the predetermined time has not elapsed, then the access controller 110 loops back to step 272.

The system 100 generates the first shared password SHARED1 and transmits it wirelessly to the second portable device 106 carried by the valet or the vehicle-service attendant. Thus, the first unshared password UNSHARED1 and the first portable device 104 do not have to be shared with the valet or the vehicle-service attendant. Thus, the system 100 ensures that the first portable device 104 may remain with the owner of the vehicle 102. This helps prevent cloning of the first portable device 104 and copying of the unshared password. In addition, a location of the first portable device 104, indicated by the first location signal LOCATION1, will indicate the location of the owner of the vehicle 102 (because the main key remains with the owner). Hence, the access controller 110 can determine the proximity of the first portable device 104 to the vehicle 102 so that instructions for customization of valet modes (limited access) preferably only can be entered into the access controller 110 when the first portable device 104 is proximate the controller 110. Further, the owner programs the access controller 110 to restrict and control the access by the valet or the vehicle-service attendant to the vehicle 102, thereby preventing the misuse of the vehicle 102 and the device 114. Since the first shared password SHARED1 expires after the predetermined time period, the valet cannot access the vehicle 102 after the predetermined time period. Further, the valet cannot operate the vehicle 102 for an indefinite period of time. The access controller 110 also controls the immobilizer 116 to enable the ignition system 118 of the vehicle 102 based on the access mode signal MODE. In the first access mode, the ignition system 118 is enabled only when the first portable device 104 is within the predetermined distance of the vehicle 102. Hence, in the first access mode, the valet neither can set the access to vehicle nor can enable the ignition system 118 of the vehicle 102. In the second and third access modes, the valet can enable the ignition system 118 with a limited supply of fuel and a restriction on engine RPMs, which prevents the vehicle from being driven too fast or too far.

Note that while the flow chart sets out certain steps in a certain order, it will be understood by those of skill in the art that the system could operate in a different way yet still perform the same functions. For example, the system could be interrupt driven such that when the predetermined time period expires, the timer sends an interrupt to a sequencer or microcontroller, rather than the software having to continually check the value of the timer.

The terms first and second logic states have been used herein to distinguish before high and low signals. For example, the first logic state could signify a signal that is 0 v while a second logic state would then indicate a signal that has a logical '1' value, with the actual voltage value for logic 1 depending on circuit technology. The circuits described herein also can be designed using either positive or negative logic, so an active signal in one embodiment could be a logic '0' and an inactive signal would then have a logic value of '1'.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. A system for controlling access to a vehicle, the system comprising:

an access controller located within the vehicle, wherein the access controller stores a first unshared password, a first shared password, and at least one access control parameter (ACP); and a first portable device in communication with the access controller, wherein the first portable device generates and transmits to the access controller a second unshared password along with one of an access mode signal that indicates at least one of a first access mode and a second access mode, and a first lock signal, wherein when the access controller is in either the first access mode or the second access mode, the access controller compares the first and second unshared passwords and if the first and second unshared passwords match then the access controller either allows access to the vehicle based on the first lock signal, or changes the access mode based on the access mode signal, and wherein when the access controller is in the second access mode:

the first portable device generates a first shared password, and transmits the first shared password to a second portable device, wherein the first shared password is a temporary password that only permits limited access to the vehicle and expires after a predetermined time, and the access controller:

receives a second lock signal along with the second shared password from the second portable device, compares the first and second shared passwords, generates at least one control output signal and an ignition control signal based on the at least one ACP and the comparison of the first and second shared passwords, and controls access to the vehicle based on the second lock signal, the at least one control output signal, and the ignition control signal.

2. The system of claim 1, further comprising:

an immobilizer connected to the access controller and an ignition system of the vehicle, wherein when the immobilizer is activated the ignition system is disabled, and when the immobilizer is deactivated, the ignition system can be activated, wherein, in the first access mode, when the first and second unshared passwords match, the access controller deactivates a door lock of the vehicle to allow the vehicle to be accessed, and when the first portable device is within a predetermined distance of the access controller then the immobilizer is deactivated so that the ignition system can be activated and the vehicle can be started, otherwise the immobilizer is activated to restrict mobility of the vehicle by disabling the ignition system, and wherein in the second access mode, the access controller deactivates the immobilizer only for the predetermined time so that the vehicle is drivable even though the first portable device is not within the predetermined distance.

3. The system of claim 2, wherein, in the second access mode, when the first and second shared passwords match, the access controller deactivates a door lock of the vehicle to allow access to the vehicle, controls the ignition system of the vehicle with the ignition control signal, and controls at least one system/device of the vehicle with the at least one control output signal.

4. The system of claim 3, wherein the at least one system/device of the vehicle comprises at least one of a fuel tank, an in-car communication and entertainment system, an air-conditioning system, at least one storage compartment, an engine, a fuel injector, a brake system, a bonnet, windows, a sunroof, a soft top of a convertible vehicle, a trunk, a glove compartment, and a child lock.

5. The system of claim 4, further comprising:

the second portable device, wherein the second portable device is in communication with at least one of the access controller and the first portable device, wherein when the access mode signal indicates the second access mode, the second portable device receives at least one of an identification number and the first shared password, generates the second shared password and the second lock signal, and transmits at least one of the identification number, the second shared password, and the second lock signal to the access controller, whereby the second portable device allows for temporary access to the vehicle without making the first and second unshared passwords available to a user of the second portable device.

6. The system of claim 5, wherein when the access controller is in the second access mode, the access controller generates and transmits the first shared password to the second portable device by way of the first portable device.

7. The system of claim 5, wherein when the access controller is in the second access mode, the first portable device generates and transmits the first shared password to both the access controller and the second portable device.

8. The system of claim 4, wherein:

when the access controller is in the first access mode, the access controller receives a location signal from the first portable device and determines whether the first portable device is within the predetermined distance of the access controller based on the location signal, when the access controller receives a customization request and the first portable device is not within said predetermined distance, the access controller generates an alert signal, and when the access controller receives the customization request and the first portable device is within said predetermined distance, the access controller also receives at least one ACP corresponding to the at least one control output signal and the ignition control signal.

9. The system of claim 4, wherein when the access controller is in a third access mode, which allows access to the vehicle for the predetermined time period only, the access controller:

generates the at least one control output signal and the ignition control signal based on the at least one ACP, deactivates the vehicle door lock to allow access to the vehicle, deactivates the immobilizer and enables the ignition system based on the ignition control signal, and controls the at least one system/device of the vehicle with the at least one control output signal, for the predetermined time period.

10. The system of claim 9, wherein upon expiration of the predetermined time period, the access controller generates a third lock signal that activates the door lock to prevent access to the vehicle, activates the immobilizer, and changes the access mode to the second access mode.

11. A method for controlling access to a vehicle and to systems/devices of the vehicle, wherein the vehicle includes an access controller located therein that is operable in first, second and third access modes, the method comprising:

storing a first unshared password, a first shared password and at least one access control parameter (ACP) in the access controller;

generating an access mode signal, a first lock signal, and a second unshared password by a first portable device, wherein the access mode signal indicates at least one of the first, second and third access modes;

transmitting one of the access mode signal, and the first lock signal, along with the second unshared password from the first portable device to the access controller;

wherein when the access controller is in any of the first, second and the third access modes:

comparing the first and second unshared passwords by the access controller; and providing access to the vehicle based on the first lock signal and the comparison result;

when the access controller is in the second access mode, the access controller also:

receiving a second shared password and a second lock signal by the access controller;

comparing the first and second shared passwords;

generating a control output signal and an ignition control signal based on the at least one ACP and the comparison of the first and second shared passwords; and controlling access to the vehicle by the access controller using the second lock signal, the control output signal, and the ignition control signal.

12. The method of claim 11, wherein when the access controller is in the first access mode and the second unshared password matches the first unshared password, the access controller controls the access to the vehicle by deactivating a vehicle door lock, and when the first portable device is within a predetermined distance from the access controller, the access controller enables an ignition system of the vehicle.

13. The method of claim 11, wherein when the access controller is in the second access mode and the second shared password matches the first shared password, controlling access to the vehicle further comprises:

deactivating a vehicle door lock based on the second lock signal; and controlling an ignition system of the vehicle and at least one of the system/devices of the vehicle using the ignition control signal and the at least one control output signal, respectively.

14. The method of claim 13, wherein the at least one system/device of the vehicle comprises at least one of a fuel tank, an in-car communication and entertainment system, an air-conditioning system, at least one storage compartment, an engine, a fuel injector, a brake system, a bonnet, windows, a sunroof, a soft top of a convertible vehicle, a trunk, a glove compartment, and a child lock.

15. The method of claim 14, wherein when the access controller is in the second access mode, the method further comprises:

generating the first shared password; and transmitting the first shared password to a second portable device.

16. The method of claim 15, wherein when the access controller is in the second access mode, the method further comprises:

receiving at least one of an identification number and the second shared password by the second portable device;

generating the second lock signal by the second portable device; and transmitting the second shared password along with at least one of the identification number, and the second lock signal from the second portable device to the access controller, whereby the second shared device allows access to the vehicle using the second shared password, and whereby the first and second unshared passwords are not accessible by the second portable device so the second unshared password is not at risk of being accessed from the second portable device.

17. The method of claim 14, further comprising:

receiving a location signal by the access controller from the first portable device, corresponding to a location of the first portable device, when the access mode signal indicates the first access mode;

determining whether the first portable device is within a predetermined distance of the access controller based on the location signal;

receiving, by the access controller, a customization request when the access controller is in the first access mode;

generating an alert signal when the access controller receives the customization request and the first portable device is not within the predetermined distance and the access controller is in the first access mode; and receiving at least one access control parameter (ACP) corresponding to the at least one control output signal and the ignition control signal when the access controller receives the customization request and the first portable device is within the predetermined distance and the access controller is in the first access mode.

18. The method of claim 11, wherein when the access controller is in the third access mode, controlling access to the vehicle further comprises:

starting a timer for indicating a beginning and an end of a predetermined time period;

deactivating a vehicle door lock to allow access to the vehicle for predetermined time period; and enabling an ignition system and controlling at least one system/device of the vehicle based on the ignition control signal and the at least one control output signal, respectively.

19. The method of claim 18, wherein controlling access to the vehicle further comprises:

generating a third lock signal at the end of the predetermined time period;

activating the vehicle door lock and disabling the ignition system based on the third lock signal, thereby preventing operation of the vehicle; and changing the access controller from the third access mode to the second access mode.

20. The method of claim 19, wherein the at least one system/device of the vehicle is at least one of a fuel tank, an in-car communication and entertainment system, an air-conditioning system, a storage compartment, an engine, a fuel injector, a braking system, a bonnet, windows, a sunroof, a soft top of a convertible vehicle, a trunk, a glove compartment, and a child lock.

* * * * *